US007479175B2

(12) United States Patent
Spiegel

(10) Patent No.: US 7,479,175 B2
(45) Date of Patent: Jan. 20, 2009

(54) SAFETY LID FOR AIR CONDITIONING DEVICE AND METHOD OF USE

(75) Inventor: Peter Spiegel, Los Angeles, CA (US)

(73) Assignee: Sylmark Holdings Limited, Dublin (IE)

( * ) Notice: Subject to any disclaimer, the term of this patent is extended or adjusted under 35 U.S.C. 154(b) by 207 days.

(21) Appl. No.: 11/328,019

(22) Filed: Jan. 9, 2006

(65) Prior Publication Data

US 2007/0157813 A1 Jul. 12, 2007

(51) Int. Cl.
*B03C 3/82* (2006.01)

(52) U.S. Cl. ..... 95/57; 55/359; 95/75; 96/39; 96/41; 96/44; 96/50; 220/796; 220/797

(58) Field of Classification Search ..... 96/15, 96/39–41, 77–79, 94, 96, 97, 43, 44, 50; 95/57, 74–76; 55/359; 422/186, 186.04; 261/81; 220/796, 797
See application file for complete search history.

(56) References Cited

U.S. PATENT DOCUMENTS 2,873,000 A * 2/1959 Elam ..... 96/77
3,289,392 A * 12/1966 Fowler ..... 96/85
4,194,888 A * 3/1980 Schwab et al. ..... 95/78
4,313,741 A * 2/1982 Masuda et al. ..... 96/78
4,663,091 A * 5/1987 Seo ..... 261/72.1
4,752,423 A * 6/1988 Wong ..... 261/142
5,578,113 A * 11/1996 Glenn ..... 96/52
5,702,507 A * 12/1997 Wang ..... 96/55
6,126,727 A * 10/2000 Lo ..... 96/39
6,713,026 B2 * 3/2004 Taylor et al. ..... 422/186.04
6,953,556 B2 * 10/2005 Taylor et al. ..... 422/186.04
6,977,008 B2 * 12/2005 Nikkhah ..... 95/74
2006/0016333 A1 * 1/2006 Taylor et al. ..... 95/76

* cited by examiner

*Primary Examiner*—Richard L Chiesa
(74) *Attorney, Agent, or Firm*—Kathy Mojibi Kavcioglu

(57) ABSTRACT

An air purifier includes a collector electrode assembly removable from an opening on the top surface of the unit and a safety lid detached from the collector electrode assembly for covering the opening on the top surface of the unit. The safety lid is configured to cover the opening whether the collector electrode assembly is at rest within the housing or has been removed from the housing for cleaning.

15 Claims, 3 Drawing Sheets

SAFETY LID FOR AIR CONDITIONING DEVICE AND METHOD OF USE

FIELD OF INVENTION

The present invention relates generally to electrostatic air conditioning devices and more particularly to a safety lid for such devices.

BACKGROUND OF THE INVENTION

Electrostatic air cleaners use electric energy to generate electrostatic forces which create air flow without the use of a fan or other moving parts. Electrostatic forces also enable the air cleaner to collect airborne contaminants such as dust, smoke, oil mist, pollen, pet dander and other small debris particles from the air circulated in dwellings, workplaces, and other structures. Generally, known electrostatic air cleaners utilize two arrays of electrodes excited by high-voltage. In a known design, the first electrode array comprises wire or rod-shaped electrodes (hereinafter "wire electrodes"), while the second electrode array comprises plate electrodes. A high-voltage generator creates an electrical charge between the first and second electrode arrays.

The particulate matter enters the region of the first electrode array and is charged before entering the region of the second electrode array, where it is removed from the air stream. Specifically, due to the high-voltage charge at the wire electrodes, free electrons are stripped off of atoms and molecules in the surrounding air. These electrons migrate to the positively charged wire electrodes, where they are collected. The removal of free electrons leaves the stripped atoms and molecules positively charged, which are repelled from the positively charged wire electrodes and attracted to the negatively charged plate electrodes. The addition of the electrons from the negatively charged plate electrodes also produces negative air ions that are propelled from the trailing edge of the plate electrodes. Thus, the ionic forces exerted on atoms and molecules create a silent movement of air through the air cleaner.

Because the plate electrodes collect the debris from the air flowing through the air cleaner, the plate electrodes need to be cleaned regularly. Typically, to clean the plate electrodes, the user removes the electrodes from the air cleaner and washes them to remove the collected debris. Warm water and a sponge may be used to facilitate the cleaning. After the plate electrodes are completely dried, they may be returned to the air purifier unit. Returning the plate electrodes to the unit while they are wet is dangerous and could cause irreparable damage to the air purifier unit. Accordingly, it is very important to allow the plate electrodes to fully dry before returning them to the air purifier unit.

FIG. 1 depicts a known electrostatic air conditioning device 100, as shown in U.S. Pat. No. 6,953,556, wherein the plate electrodes 110 are attached to a handle 120. To remove the plate electrodes 110 for cleaning, the user pulls the handle 120 up vertically, pulling the plate electrodes out of an opening 130 in the top surface 135 of the device. The handle serves two purposes: it assists the user with vertically removing the electrodes out of the housing and it covers the opening in the top surface when the plate electrodes are at rest in the air purifier.

The disadvantage of the known device 100 is that when the plate electrodes 110 are removed for cleaning, an open hole 130 remains on the top surface 135 of the air purifier 100. Leaving an exposed opening in the top surface of the air purifier for an extended period of time can be dangerous and unsightly. The air purifier includes various electronic components that are exposed and accessible through the opening 130 in the top surface 135. When the plate electrodes are removed, a child can easily reach through the hole into the unit and can cause damage to the unit or to himself. Furthermore, foreign objects can be dropped into the device, interfering with the operation of the device when it is turned on. The presence of a foreign object in an electrostatic air purifier is not only harmful to the air purifier but could be dangerous to the user, particularly if the foreign object is a metallic item that could interfere with the electrical operation of the air purifier. Furthermore, if dust or other debris gathers in the unit when the top is left open, the safety and efficiency of the unit could be affected.

Accordingly, there is a need for an air purifier having a safety cap which can be utilized to keep the unit free of dust, debris and other foreign objects while the collector blades are being cleaned.

Furthermore, there is a need to prevent access to the internal components of the air purifier unit when the collector blades to be cleaned are removed and for the duration of the cleaning.

SUMMARY OF PREFERRED EMBODIMENTS

An air purifier is disclosed having a safety lid for preventing access to the unit and keeping the internal components of the unit free of debris when the collector plates are removed for cleaning. The terms air purifier, air cleaner and air conditioner are used interchangeably herein and are intended to have the same meaning. The air purifier includes a collector electrode assembly removable from an opening on the top surface of the unit and a safety lid detached from the collector electrode assembly for covering the opening on the top surface of the unit. The safety lid is configured to cover the opening whether the collector electrode assembly is at rest within the housing or has been removed from the housing for cleaning.

DETAILED DESCRIPTION OF PREFERRED EMBODIMENTS

Figure 2:
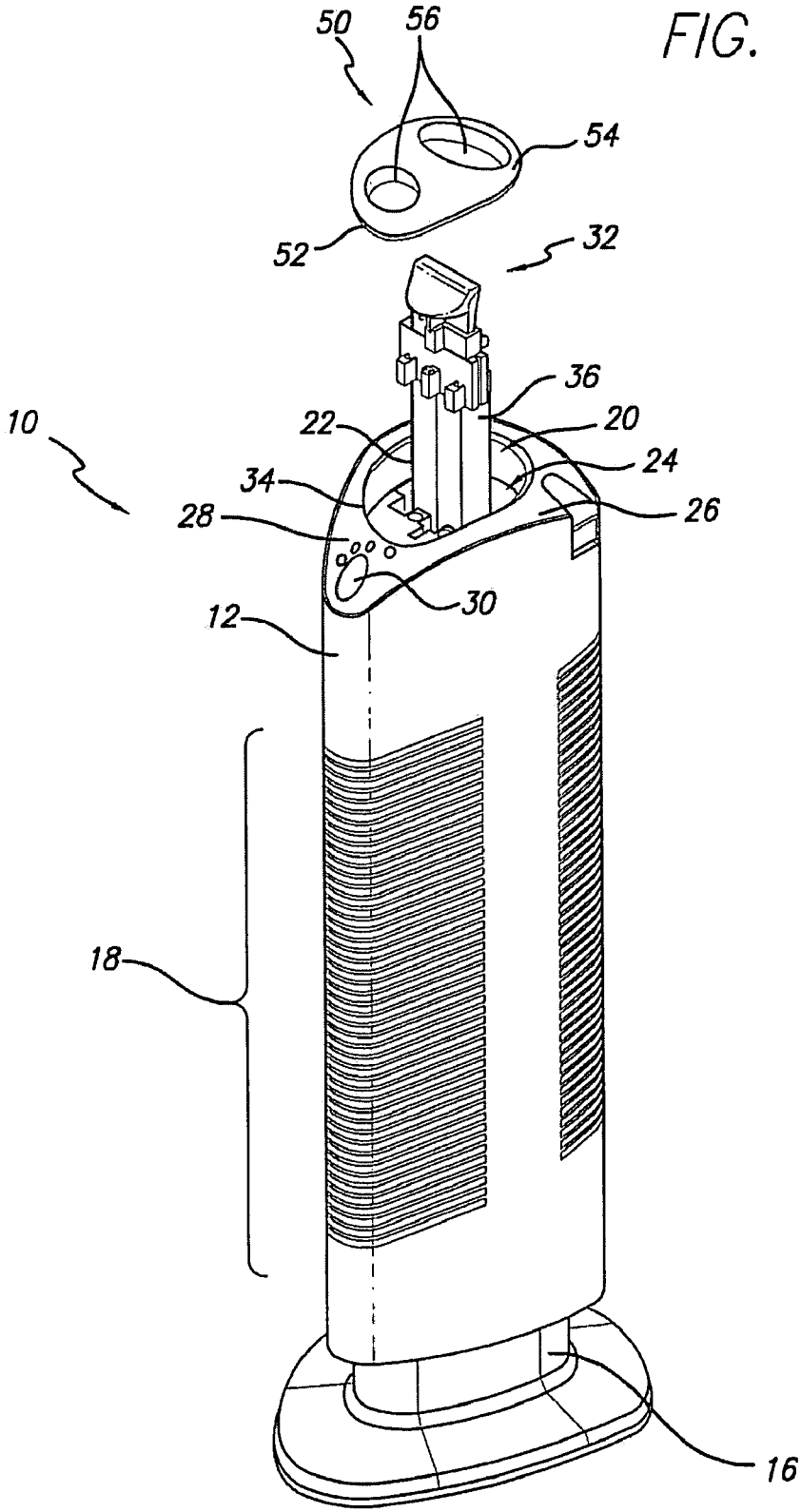
FIG. 2 is a perspective view of a preferred embodiment of the air purifier of the present invention having a removable safety lid.

As shown in FIG. 2, a preferred embodiment of the air purifier 10 of the present invention includes an elongated body 12 positioned on a base 14. A neck portion 16 supports the elongated body on base 14. The body 12 includes a vertical channel 18 therein for housing the collector electrodes 20 when the air purifier is in use. Louvers or slats 18 are provided on the elongated body 12 to allow air to flow through the vertical channel 22.

The operation of the air purifier is the same as known electrokinetic air purifiers. Namely, a first electrode array (not shown) and a second electrode array 20 are provided in the vertical channel 22. In the embodiment shown in FIG. 1, the second electrode array 20 includes metal electrode blades or plates. It is to be understood that the first and second electrode arrays can have various shapes and configurations, all of which are included in the scope of the present invention. A high voltage generator creates an electric charge between the electrode arrays. The resulting ionic forces create a silent movement of air through the vertical channel 22 of the air purifier.

Figure 1:
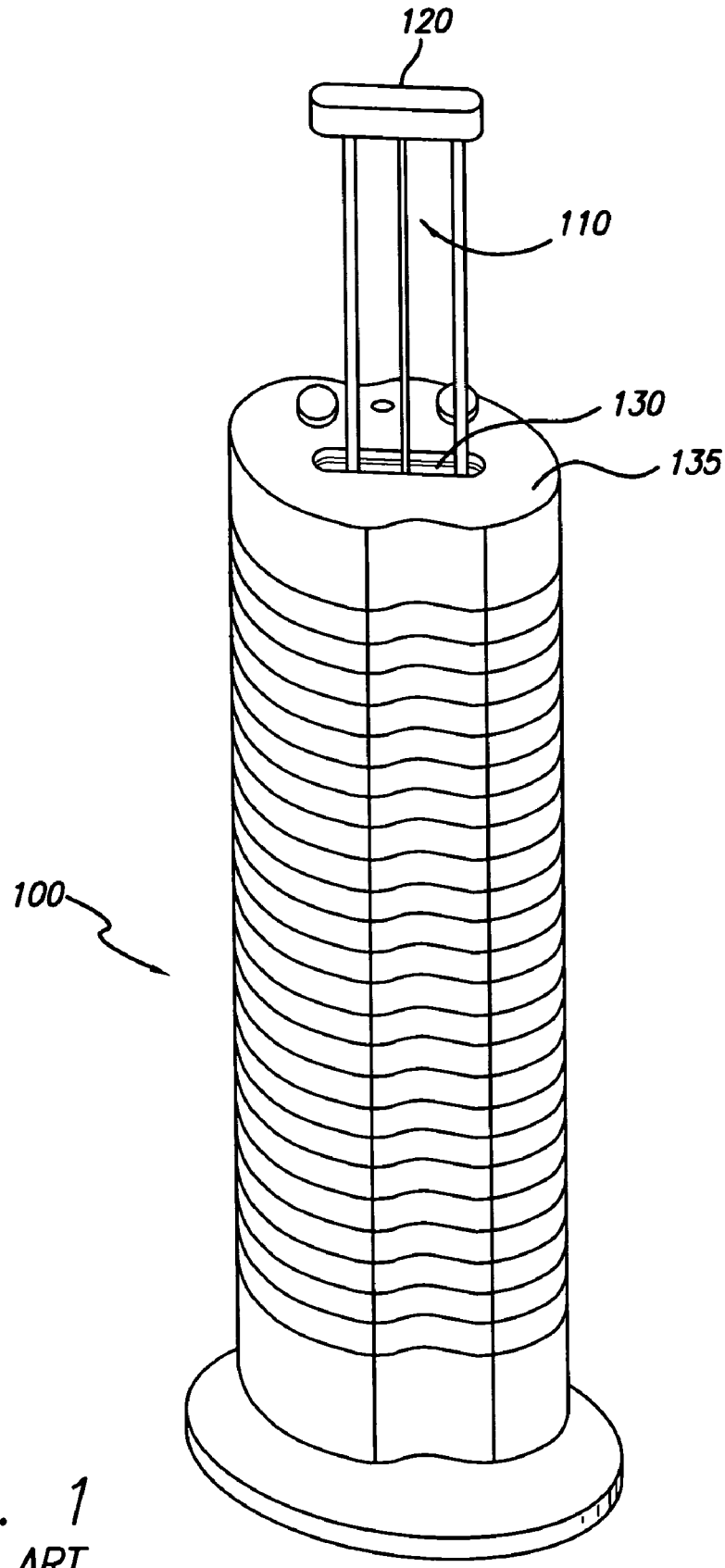
FIG. 1 PRIOR ART
FIG. 1 is a perspective view of a known air purifier having a handle attached to the collector plates, wherein the handle extends through an opening in the top surface of the housing and covers the opening.

As shown in FIG. 1, the collector electrodes 20 can be removed for cleaning through an opening 24 in the top surface 26 of the air purifier 10. The opening 24 must be sufficiently large to allow the collector electrodes 20 to be removed easily through the opening. However, in a preferred embodiment of the invention, the opening 24 does not define the entire top surface 26 of the air purifier 10. Therefore, the top surface 26 preferably includes opening 24 and outlying surfaces 28 surrounding the opening. A control panel 30 is provided on a portion of the outlying surface 28.

In a preferred embodiment of the invention, a handle 32 is provided to facilitate the removal of the collector electrodes 20 through the opening 24. The handle 32 is preferably attached at an upper end 34 of the collector electrodes 20 and is sized to be easily gripped and pulled by the user. It is envisioned that the handle can have many forms. In the embodiment shown in FIG. 1, the handle 32 is an arch-shaped extension sized to be comfortably grasped by a user. In a preferred embodiment, the handle 32 has a cut-out portion therein to receive the user's fingers therethrough and allow the user to have a tighter grip on the handle.

Figure 3:
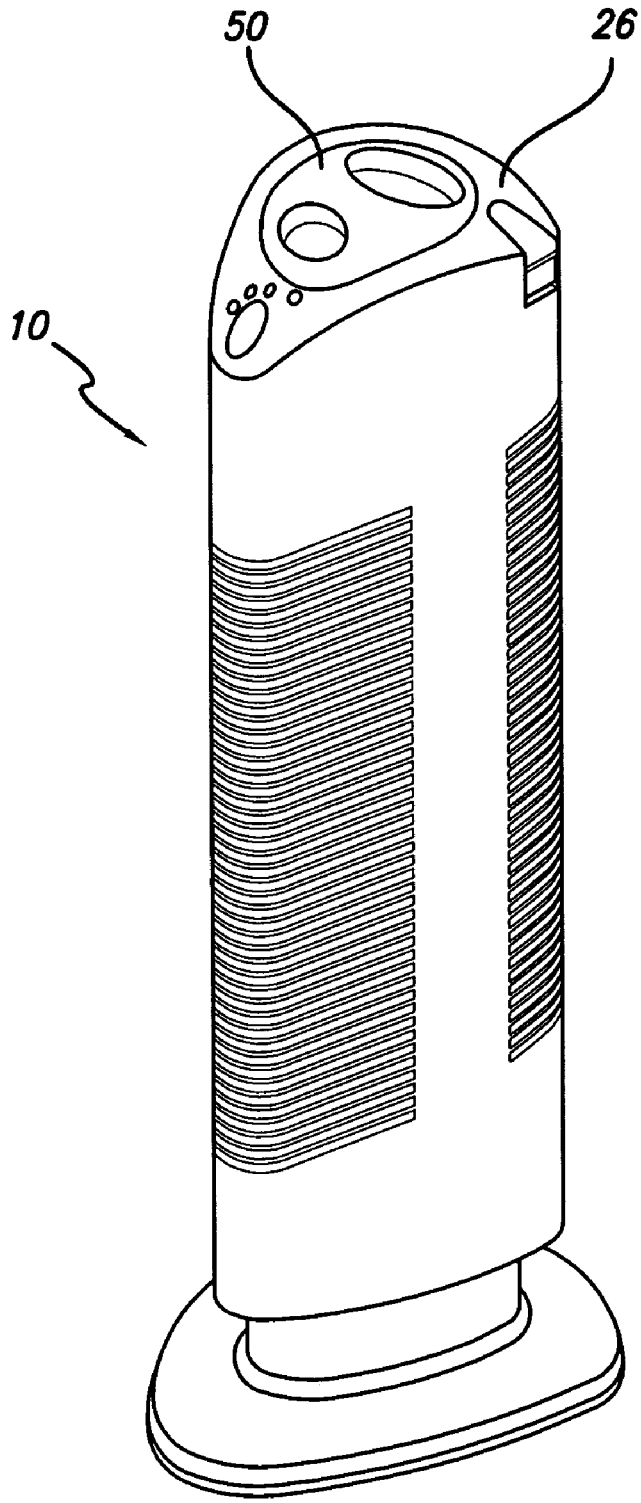
FIG. 3 is a perspective view of a preferred embodiment of the air purifier of the present invention showing the safety lid in operation during the cleaning of the collector blades.

The handle 32 is preferably substantially smaller than opening 24. When the collector electrodes 20 are at rest within the vertical channel 22, the opening 24 remains substantially uncovered. A safety lid 50 is provided to cover the opening 24 on the top surface 26 of the air purifier. The safety lid 50 is not attached to the collector electrodes 20, allowing the lid 50 to be used independently of the collector electrodes 20. The lid 50 is preferably shaped like the opening 24 such that the lid 50 substantially covers the opening 24 when the lid is placed thereon. For example, in the embodiment shown in FIGS. 2 and 3, the opening 24 has an ovoid shape and the lid has a corresponding ovoid shape.

In a preferred embodiment of the invention, the lid includes a lip 52 extending along the outer edge of the lid 50. The lip 52 is dimensioned to sit on a ledge 34 defined within the vertical channel 22. As shown in FIG. 2, when the lip 52 of the lid 50 is positioned on the ledge 34, the top surface 54 of the lid is preferably flush with the top surface 26 of the air purifier.

In a preferred embodiment of the invention, the lid 50 includes a pair of depressions 56 to facilitate the removal of the lid. To remove the lid, the user inserts his or her fingers in the depressions 56 to grip the lid 50, and then pulls the lid vertically upward to separate the lid from the air purifier. In another preferred embodiment, the lid can be threadingly mated with the side wall 36 of the vertical channel. In another embodiment, the lid 50 can be mated with the side wall 36 by a tongue and groove interlocking mechanism, wherein the lid carries a tongue that fits into a groove defined in the side wall 36. There are many other known mechanisms that can be utilized to interlock the lid with the air purifier when the lid is placed thereon. It is envisioned that the scope of the invention includes any interlocking mechanism that mates the lid with the air purifier, when the lid is placed thereon. In the embodiments wherein the lid 50 is matingly attached to the side wall 36 of the vertical channel 22, the depressions 56 can be used to facilitate the twisting of the lid 50, to release the lid from the interlocking engagement with the air purifier.

To clean the electrodes, the lid 50 is removed from the air purifier unit. The user then reaches through opening 24 to access the handle 32. The handle is grasped and pulled vertically upward, pulling the collector electrodes vertically upward through the opening. When the collector electrodes 20 are completely removed from the air purifier, the lid 50 is returned to the top surface of the air purifier. The collector electrodes can then be washed to remove all of the collected debris gathered on the electrodes. Warm water and a sponge may be used to facilitate the cleaning.

After the collector electrodes are washed, it is important to allow the electrodes to completely dry before returning them to the air purifier unit. While the electrodes are drying, the safety lid prevents access to the internal components of the air purifier. Therefore, the safety lid prevents children (or adults) from reaching into the unit and causing harm to themselves or the unit. Furthermore, the safety lid of the present invention prevents dust, debris or other foreign objects from falling or settling into the air purifier.

In known prior art devices, the internal components of the air purifier remain accessible while the plate electrodes are being cleaned. The longer the plate electrodes are out of the housing, the greater the opportunity for compromising the safety and efficiency of the unit. When using the prior art devices, the user has a dilemma. The longer the plate electrodes are out of the housing, the greater the risk of a safety problem arising. Yet to return the plate electrodes to the housing while they are not yet completely dried could be dangerous in itself. The safety lid of the present invention ensures that the safety and efficiency of the unit is not compromised while the collector electrodes are removed from the air purifier unit. Therefore, the user can rest easy and allow the collector electrodes to completely dry without worrying about the increased risks associated with the prior art devices.

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. An air purifier comprising:

a body having a top surface, an opening defined in the top surface and a vertical channel therein, wherein the size of the opening is smaller than the top surface;

a ledge defined in the vertical channel, the ledge forming a closed loop;

a collector electrode assembly sized to fit within the vertical channel and removable from the opening of the top surface of the body;

a handle attached to the collector electrode, wherein the handle is smaller than the opening;

a safety lid detached from the collector electrode assembly, the safety lid comprising an outer edge and a lip extending along the outer edge;

wherein in a covered configuration, the lip of the safety lid sits on the ledge of the vertical channel and the safety lid substantially covers the opening of the top surface without using any fasteners.

2. The air purifier of claim 1 wherein the safety lid comprises a top surface and wherein in the covered configuration, the top surface of the safety lid is flush with the top surface of the body.

3. The air purifier of claim 1 wherein the safety lid comprises two depressions positioned on a top surface of the lid, wherein the depressions are positioned and sized to facilitate the grasping of the lid.

4. The air purifier of claim 1 wherein the safety lid is matingly interlocked with body.

5. The air purifier of claim 1 wherein the safety lid is hingedly attached to the body.

6. The air purifier of claim 1 wherein the handle is arch-shaped.

7. The air purifier of claim 1 wherein in the covered configuration, the safety lid is positioned vertically spaced apart from the handle of the collector electrode assembly.

8. A method of maintaining the safety of an air purifier when the collector electrode assembly of the air purifier is removed for cleaning:

providing an air purifier with a body having a top surface, an opening defined in the top surface and a vertical channel therein, wherein the collector electrode assembly rests in the vertical channel and is removable through the opening in the top surface, a ledge defined in the vertical channel, the ledge forming a closed loop and a lid having an outer edge and a lip extending along the outer edge, the lid being sized to cover the opening in the top surface;

lifting the lid to access the vertical channel;

removing the collector electrode assembly through the opening for cleaning; and placing the lid on the opening such that the safety lid lip sits on the ledge and the lid covers the opening without the use of any fasteners while the collector electrode assembly is being cleaned.

9. The method of claim 8 wherein the collector electrode assembly comprises a handle extending therefrom.

10. The method of claim 9 wherein the handle is arch-shaped.

11. The method of claim 8 wherein the lid is matingly interlocked with the body of the air purifier.

12. The method of claim 8 wherein the lid is hingedly attached to the body.

13. The method of claim 8 wherein the lid is flush with the top surface of the air purifier.

14. The method of claim 8 wherein the lid comprises a depression to facilitate the gripping and removal of the lid.

15. An air purifier comprising:

a body having a top surface, an opening defined in the top surface and a vertical channel therein, wherein the size of the opening is smaller than the top surface;

a ledge defined in the vertical channel, the ledge forming a closed loop;

a collector electrode assembly sized to fit within the vertical channel and removable from the opening of the top surface of the body;

a handle attached to the collector electrode, wherein the handle is smaller than the opening and the handle extends vertically upward from the collector electrode assembly;

a safety lid detached from the collector electrode assembly, the safety lid comprising an outer edge and a lip extending along the outer edge;

wherein in a covered configuration, the lip of the safety lid sits on the ledge of the vertical channel and the safety lid substantially covers the opening of the top surface without the use of any fasteners.

* * * * *